US009851144B2

(12) United States Patent
Durst

(10) Patent No.: US 9,851,144 B2
(45) Date of Patent: Dec. 26, 2017

(54) METHOD AND DEVICE FOR DRYING A FLUID FILM APPLIED TO A SUBSTRATE

(75) Inventor: Franz Durst, Langensendelbach (DE)

(73) Assignee: FMP TECHNOLOGY GMBH FLUID MEASUREMENTS & PROJECTS, Erlangen (DE)

( * ) Notice: Subject to any disclaimer, the term of this patent is extended or adjusted under 35 U.S.C. 154(b) by 858 days.

(21) Appl. No.: 14/234,708

(22) PCT Filed: Jul. 20, 2012

(86) PCT No.: PCT/EP2012/064305

§ 371 (c)(1),
(2), (4) Date: Mar. 5, 2014

(87) PCT Pub. No.: WO2013/017441

PCT Pub. Date: Feb. 7, 2013

(65) Prior Publication Data

US 2014/0215844 A1 Aug. 7, 2014

(30) Foreign Application Priority Data

Aug. 1, 2011 (DE) ..... 10 2011 080 222
Jun. 20, 2012 (DE) ..... 10 2012 210 431

(51) Int. Cl.
*F26B 3/20* (2006.01)
*F26B 3/18* (2006.01)
*F26B 13/10* (2006.01)

(52) U.S. Cl.
CPC ..... *F26B 3/20* (2013.01); *F26B 3/18* (2013.01); *F26B 13/10* (2013.01)

(58) Field of Classification Search
CPC ..... F26B 3/20; F26B 13/10; F26B 3/18
See application file for complete search history.

(56) References Cited

U.S. PATENT DOCUMENTS

| | | | | |
|---|---|---|---|---|
| 2,272,776 A | | 2/1942 | Pennell | |
| 4,365,423 A | | 12/1982 | Arter et al. | |
| 5,147,690 A | | 9/1992 | Faust et al. | |
| 5,393,328 A | * | 2/1995 | Barbe | B01D 53/22 96/14 |
| 5,423,260 A | | 6/1995 | Goldberg et al. | |
| 2006/0192317 A1 | | 8/2006 | Paulson et al. | |
| 2007/0110894 A1 | | 5/2007 | Komatsubara et al. | |

(Continued)

FOREIGN PATENT DOCUMENTS

| | | |
|---|---|---|
| DE | 3900957 A1 | 7/1990 |
| DE | 19503775 C1 | 3/1996 |

OTHER PUBLICATIONS

PCT, "International Search Report for International Application No. PCT/EP2012/064305".

*Primary Examiner* — Jessica Yuen
(74) *Attorney, Agent, or Firm* — Manabu Kanesaka

(57) ABSTRACT

A method for drying a fluid film, which is applied to a surface of a substrate and includes a vaporizable liquid, includes following steps: transporting the substrate on a transport surface of a transport device along a transport direction through a drying device; vaporizing the liquid by way of a heat source having a heating surface, wherein the heating surface is disposed at a distance of 0.1 mm to 5.0 mm opposite to a surface of the substrate; and removing a vaporized liquid in a direction of the heat source.

20 Claims, 7 Drawing Sheets

(56) References Cited

U.S. PATENT DOCUMENTS

2008/0200018 A1* 8/2008 Kawamoto ..... H01L 21/02057
438/530
2009/0232982 A1* 9/2009 Ito ..... B05D 3/007
427/243

* cited by examiner

METHOD AND DEVICE FOR DRYING A FLUID FILM APPLIED TO A SUBSTRATE

RELATED APPLICATIONS

The present application is National Phase of International Application No. PCT/EP2012/064305 filed Jul. 20, 2012, and claims priority from German Applications No. 10 2011 080 222.3, filed Aug. 1, 2011 and No. 10 2012 210 431.3, filed Jun. 20, 2012.

The invention relates to a method and to a device for drying a fluid film that is applied to a substrate and includes a vaporizable liquid.

It is known from the prior art to coat surfaces of web-shaped goods. The web-shaped goods can be paper, plastic films, textiles or metal strips, for example. So as to coat the surface, a fluid film is applied, which includes a vaporizable liquid and non-vaporizable components. The fluid film is solidified by vaporizing the vaporizable liquid. This process is referred to as drying of the fluid layer.

So as to solidify or dry the fluid film, it is known from DE 39 27 627 A1, for example, to flow a heated drying gas against both an underside of the substrate and an upper side that is located opposite thereof and provided with the fluid film. In a method known from DE 39 00 957 A1, a drying gas flowing along the surface of the fluid film is accelerated in the flow direction. —The aforementioned drying methods have the disadvantage that the formation of undesirable mottles occurs on the surface of the fluid film due to the action of the drying gas.

So as to overcome this disadvantage, it is known from WO 82/03450 to provide a foraminous filter layer at a distance above the fluid film. The flow of the drying gas is slowed in the region above the fluid layer as a result of the action of the filter layer, whereby turbulent flows are avoided. However, a liquid vapor escaping from the fluid film can thus not be removed particularly quickly. This drying method is not particularly efficient.

Large volumes of drying gas are required in the drying methods known from the prior art, which subsequently must be purified and/or regenerated in a complex process.

It is the object of the invention to eliminate the disadvantages of the prior art. In particular a method and a device are to be provided, by way of which a fluid film that is applied to a substrate can be dried, while avoiding the formation of mottles and achieving improved efficiency, without having to move large amounts of air.

This object is achieved by main features of the invention. Advantageous embodiments of the invention will be apparent from other features of the invention.

According to the invention, a method for drying a fluid film, which is applied to a surface of a substrate and includes a vaporizable liquid, is proposed, comprising the following steps:

transporting the substrate on a transport surface of a transport device along a transport direction through a drying device;

vaporizing the liquid by way of a heat source having a heating surface, wherein the heating surface is disposed at a distance of 0.1 mm to 15.0 mm opposite the substrate surface; and removing the vaporized liquid by generating a flow that is directed from the fluid film in the direction of the heat source.

Contrary to the prior art, in the proposed method the liquid is essentially vaporized by way of a heat source that is provided opposite the substrate. As a result, the effort that is required to heat the drying gas is dispensed with. The additional effort for purifying or regenerating the drying gas can be considerably reduced. Using the method proposed according to the invention, drying rates of up to 20 g/m$^2$s can be achieved. This corresponds to approximately 10 times the drying rates that are achieved with methods known from the prior art.

By disposing the heating surface of the heat source only at a distance of 0.1 mm to 15.0 mm, preferably 0.2 to 5.0 mm, opposite the substrate surface, which is also contrary to the prior art, the heat in the method according to the invention is essentially supplied to the fluid film by direct heat conduction. In this way it is advantageously achieved that the fluid film is heated starting from the interface thereof facing the heating surface, in the direction of the substrate surface. Contrary to the input of heat by way of heat radiation, which is essentially absorbed on the substrate surface, particularly effective vaporization or diffusion, respectively, of the liquid can thus be achieved.

Moreover, the vaporized liquid is removed in the direction of the heat source by the applied temperature gradient. This means that the vaporized liquid essentially flows perpendicularly away from the interface and then reaches a channel that is formed by the interface and the heating surface. Within the fluid film, the generation of a flow of high air volumes that is directed essentially parallel to the interface is largely avoided. As a result, no formation of mottles occurs in the fluid film with the method according to the invention.

According to a further particularly advantageous embodiment of the invention, a gas flow is generated in the channel that is formed between the heating surface and the interface to remove the vaporized liquid opposite to the transport direction of the substrate. The gas flow can be generated by way of a suction device, for example, which is provided at the upstream end of the channel. In this way, the vaporized liquid is moved in the direction of the respective upstream neighboring heat source. A flow velocity of the gas flow conducted in the opposite direction as the transport direction of the substrate is expediently 2 cm/s to 30 m/s, and preferably 10 cm/s to 10 m/s. The flow velocity of the gas is dependent on the length of the channel and the amount of liquid to be vaporized. If the liquid to be vaporized is flammable, the selected gas should be an inert gas.

According to one advantageous embodiment, a first temperature $T_G$ of the heating surface is controlled as a function of an interface temperature $T_I$ of the fluid film. The first temperature $T_G$ is set in such a way that the required removal of the released fluid vapor from the surface is ensured. The heat is advantageously essentially transmitted from the heating surface to the fluid film by way of direct heat conduction.

The first temperature $T_G$ is expediently controlled in the range of 50° C. to 300° C., and preferably in the range of 80° C. to 200° C.

According to a further advantageous embodiment, the transport surface is heated by way of an additional heat source. A second temperature $T_H$ of the transport surface generated by the additional heat source is advantageously controlled as a function of the interface temperature $T_I$. The second temperature $T_H$ can in particular be controlled so that the following relationship is met:

$$T_H = T_I + \Delta T, \text{ where}$$

$T_I$ ranges from 10° C. to 50° C. and $\Delta T$ ranges from 10° C. to 40° C., and preferably from 20° C. to 30° C.

The transport surface cools off as a result of the vaporization of the liquid. So as to increase the mass flow rate of the vaporized liquid, the transport surface is heated to a second temperature $T_H$ by way of an additional heat source. For this purpose, the second temperature $T_H$ is set so as to be higher than the interface temperature $T_I$. A particularly high mass flow rate of the vaporized liquid is advantageously achieved when the difference $\Delta T$ between the interface temperature $T_I$ and the second temperature $T_H$ ranges from 2° C. to 30° C.

The vaporization of the liquid is expediently carried out in a non-flammable gas atmosphere, and preferably a nitrogen or carbon dioxide atmosphere. In this way, a flammable liquid that is vaporized within the drying device can be safely and reliably prevented from igniting.

According to a further particularly advantageous embodiment, the heating surface facing the substrate is disposed at a distance of 0.2 mm to 5.0 mm, and preferably 0.2 to 1.0 mm, opposite the substrate surface. The proposed small distance between the heating surface and the substrate surface allows particularly homogeneous heating of the fluid film, and thus uniform vaporization of the liquid. A thickness of the fluid film can, of course, be selected so as to be smaller than the above-mentioned distance. For example, the thickness of the fluid film may range from 5 μm to 200 μm, and preferably from 10 μm to 50 μm.

According to a further advantageous embodiment, the second temperature $T_H$ is controlled so as to always be lower than the first temperature $T_G$. A temperature difference between the first temperature $T_G$ and the second temperature $T_H$ can in particular be controlled so that a predetermined temperature difference profile develops along the transport device. The temperature gradient or the temperature difference between the first temperature $T_G$ and second temperature $T_H$ can change along the transport direction in a predetermined way. This takes the circumstance into consideration that the amount of liquid to be vaporized decreases in the transport direction. The change of the temperature gradient can also be caused by a suitable control of the first temperature $T_G$ and/or second temperature $T_H$ or by a change of the distance of the heating surface from the interface.

It has proven to be particularly advantageous to use a heat source through which a flow is possible as the heat source and to remove the vaporized liquid through the heat source. In this way, the vaporized liquid can essentially be removed perpendicularly from the surface of the fluid film or the interface.

The heat source is expediently an electric heating source, and preferably a heating source that is equipped with resistance wires. The resistance wires can be disposed in a grid-shaped manner, for example. It is also possible to use at least one heat exchanger as the heat source. Such a heat exchanger can be designed in a flow-through manner, similar to a radiator for motor vehicles. It is also possible to provide multiple heat exchangers behind one another in the transport direction, wherein a gap can be provided in each case between the heat exchangers. The vaporized liquid can be removed from the surface of the fluid film through this gap.

According to a further advantageous embodiment of the invention, at least one rotatable roller is used as the transport device, the lateral face of which forms the transport surface. Such a transport device can have a relatively compact design. Moreover, it can be combined with a slotted nozzle tool for applying the fluid film. If a rotatable roller is used as the transport device, the heat source is designed in a manner corresponding to the lateral face of the roller, which is to say a heating surface of the heat source is disposed at a predetermined small distance from the lateral face. The additional heat source is disposed within the roller. —The transport surface is heated by way of the additional heat source starting from an underside of the transport device located opposite the substrate, preferably by way of direct heat conduction. The transport surface can be electrically heated by way of resistance heating elements, for example. Such electrical heating allows the temperature of the transport surface to be controlled particularly easily.

According to the invention, a device for drying a fluid film, which is applied to a surface of a substrate and includes a vaporizable liquid, is also proposed, comprising:

a transport device for transporting the substrate on a transport surface along a transport direction;

a heat source that is provided opposite the substrate and has a heating surface, which is disposed at a distance of 0.1 mm to 15.0 mm opposite the substrate surface; and a device for generating a flow that is directed from the fluid film in the direction of the heat source.

The proposed device allows efficient drying of a fluid film that is applied to a substrate. The liquid is vaporized for this purpose by a heat source provided opposite the substrate. Contrary to the prior art, the heat source is disposed at a distance of only 0.1 to 15.0 mm, and preferably of 0.1 to 5.0 mm, from the substrate surface. The vaporized liquid is removed by generating a flow that is directed from the substrate in the direction of the heat source. A device for removing the vaporized liquid is provided for this purpose.

According to an advantageous embodiment, an additional heat source is provided for heating the transport surface. The additional heat source is expediently provided on an "underside" of the transport device located opposite the substrate. This can be a resistance heater, for example.

According to a further advantageous embodiment, a first controlling device is provided for controlling a first temperature $T_G$ generated by the heating surface as a function of an interface temperature $T_I$ of the fluid film. The controlled variable, which is to say the first temperature $T_G$ of the heating surface, is set according to a predetermined algorithm as a function of the interface temperature $T_I$, which forms the reference variable. The first temperature $T_G$ can be controlled, for example, so that a predetermined temperature gradient forms between the interface temperature $T_I$ and the first temperature $T_G$.

Moreover, a second controlling device is advantageously provided for controlling a second temperature $T_H$ of the transport surface as a function of the interface temperature $T_I$. In this case, the interface temperature $T_I$ is measured as the reference variable. The second temperature $T_H$ is set or updated by way of the controlling device as a function of the measured interface temperature $T_I$. The setting or updating of the second temperature $T_H$ is expediently carried out in such a way that a predetermined interface temperature $T_I$ is essentially kept constant.

The first temperature $T_G$ and the second temperature $T_H$ can be measured by way of conventional thermocouples, for example. The interface temperature $T_I$ can be detected in a non-contact manner, for example by way of an infrared measuring device.

The first controlling device may also be dispensed with. In this case, the first temperature $T_G$ is kept constant. —The first and second controlling devices can also be coupled. A temperature gradient between the first temperature $T_G$ and the second temperature $T_H$ can be controlled according to a further predetermined algorithm so that a predetermined temperature difference profile develops along the transport direction between the transport surface and the heating surface.

Reference is made to the description of the embodiments of the method for the advantageous embodiment of the device. The embodiment features described with respect to the method apply analogously also to embodiments of the device.

The invention will be described in more detail hereafter based on the drawings: In the drawings.

The theoretical principles of the method according to the invention will be briefly described hereafter based on one-dimensional equations for the diffuse mass transport as a function of the temperature.

Figure 1:
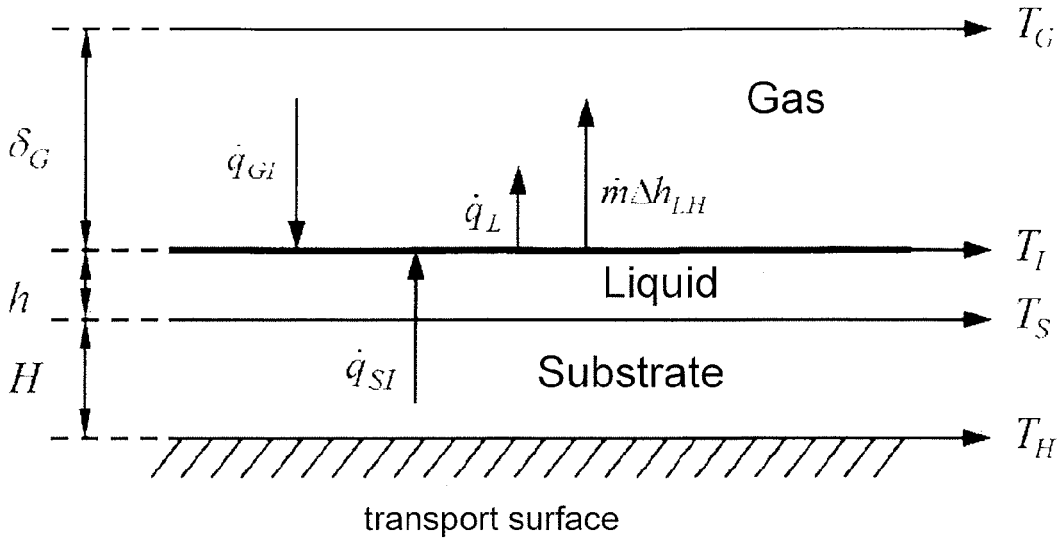
FIG. 1 shows a schematic illustration to explain the variables used in the formulas.

The variables used in the following equations are essentially apparent from FIG. 1.

The temperature gradient in the air gap above the interface of the fluid film fulfills the energy equation, which can be stated as follows for the gas phase:

$$\frac{d^2T}{dy^2} - \left(\frac{\dot{m}C_P}{\lambda_G}\right)\frac{dT}{dy} = 0$$

Upon solving this diffusion equation, the following general solution is obtained:

$$T = c_1 + c_2\exp\left(\frac{\dot{m}C_P}{\lambda_G}y\right),$$

where $c_1$ and $c_2$ represent two constants of integration still to be defined. These can be determined via suitable boundary values. These boundary values are as follows:

$$y = 0\frac{dT}{dy}\bigg|_{I/G} = \frac{(1-f)*(T_H - T_I)}{\left(\frac{\mu_G\Delta h_{LH}}{2T_I} - \lambda_G\right)*\left(\frac{H}{\lambda_S} + \frac{h}{\lambda_L}\right)}$$

-continued $$y = \delta_G,$$

$$T = T_G$$

If the above equations are solved by inserting the boundary values according to $c_1$ and $c_2$, values are obtained for these variables which allow the temperature profile in the gas phase to be indicated as follows:

$$T = T_G - \frac{(1-f)*(T_H - T_I)*\left\{\exp\left(\frac{\dot{m}C_P}{\lambda_G}\delta_G\right) - \exp\left(\frac{\dot{m}C_P}{\lambda_G}y\right)\right\}}{\dot{m}C_P*\left(\frac{\mu_G\Delta h_{LH}}{2\lambda_G T_I} - 1\right)*\left(\frac{H}{\lambda_S} + \frac{h}{\lambda_L}\right)}$$

For y=0, $T=T_1$ is obtained. This allows the interface temperature $T_1$, which is to say the temperature on the free surface of the fluid film, to be calculated as follows:

$$T_I = T_G - \frac{(1-f)*(T_H - T_I)*\left\{\exp\left(\frac{\dot{m}C_P}{\lambda_G}\delta_G\right) - 1\right\}}{\dot{m}C_P*\left(\frac{\mu_G\Delta h_{LH}}{2\lambda_G T_I} - 1\right)*\left(\frac{H}{\lambda_S} + \frac{h}{\lambda_L}\right)}$$

The mass diffusion rate per unit area can be calculated as follows based on the temperature gradient that is present on the free surface:

$$\dot{m} = \frac{(1-f)*\mu_G*(T_H - T_I)}{(\mu_G\Delta h_{LH} - 2\lambda_G T_I)*\left(\frac{H}{\lambda_S} + \frac{h}{\lambda_L}\right)}$$

The drying time for the material to be coated can be calculated as follows:

$$t_d = \frac{M}{\dot{m}} = \frac{\rho_L*h*(\mu_G\Delta h_{LH} - 2\lambda_G T_I)*\left(\frac{H}{\lambda_S} + \frac{h}{\lambda_L}\right)}{(1-f)*\mu_G*(T_H - T_I)}$$

Using the above set of equations, the one-dimensional diffusion heat transfer problem and the problem of the associated release of mass and of the mass transport can be solved analytically.

Using the boundary values described below, the mass diffusion rate of the vaporized liquid and the drying time were calculated. The calculation was made under the following assumptions:

$H$=300 μm, $h$=10 μm, $\delta_G$=300 μm $f$=0.2, $T_G$=350 K, $T_H$=295 K

The following material properties were assumed to be constant, despite the temperature changes:

$\mu_G=1.8\times10^{-5}$ kg/(ms), $\lambda$=0.024 W/(mK), $C_P$=1.012 KJ/(KgK)

$\lambda_L$=0.6 W/(mK), $\rho_L$=1000 kg/m$^3$, $\Delta h_{LH}$=2260 KJ/Kg $\lambda_S$=0.12 W/(mK)

The drying of the fluid film according to the invention is essentially determined by controlling the second temperature $T_H$ on the transport surface and by the first temperature $T_G$ of the heat source. The heat source is provided at a distance $\delta_G$ from the interface of the fluid film facing the gas phase.

Figure 2:
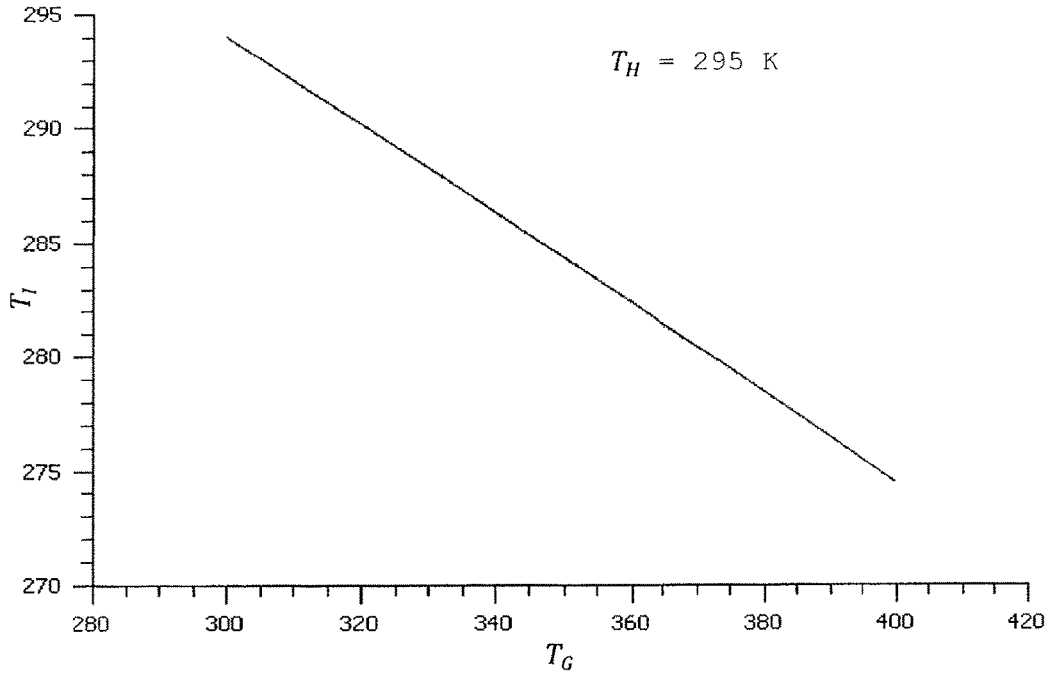
FIG. 2 shows the interface temperature as a function of the gas temperature at a predetermined transport surface temperature.
Figure 3:
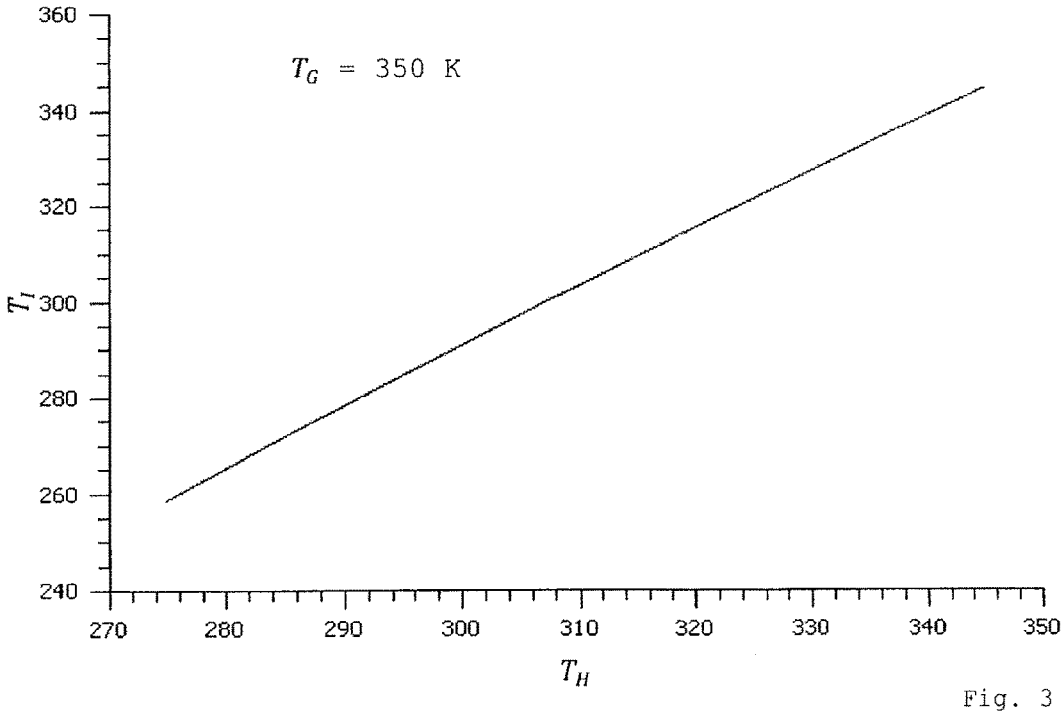
FIG. 3 shows the interface temperature as a function of the transport surface temperature at a predetermined gas temperature.

FIG. 2 shows the interface temperature $T_I$ as a function of the first temperature $T_G$ of the heat source or gas phase. FIG. 3 shows the interface temperature $T_I$ as a function of the temperature $T_H$ of the transport surface.

Figure 4:
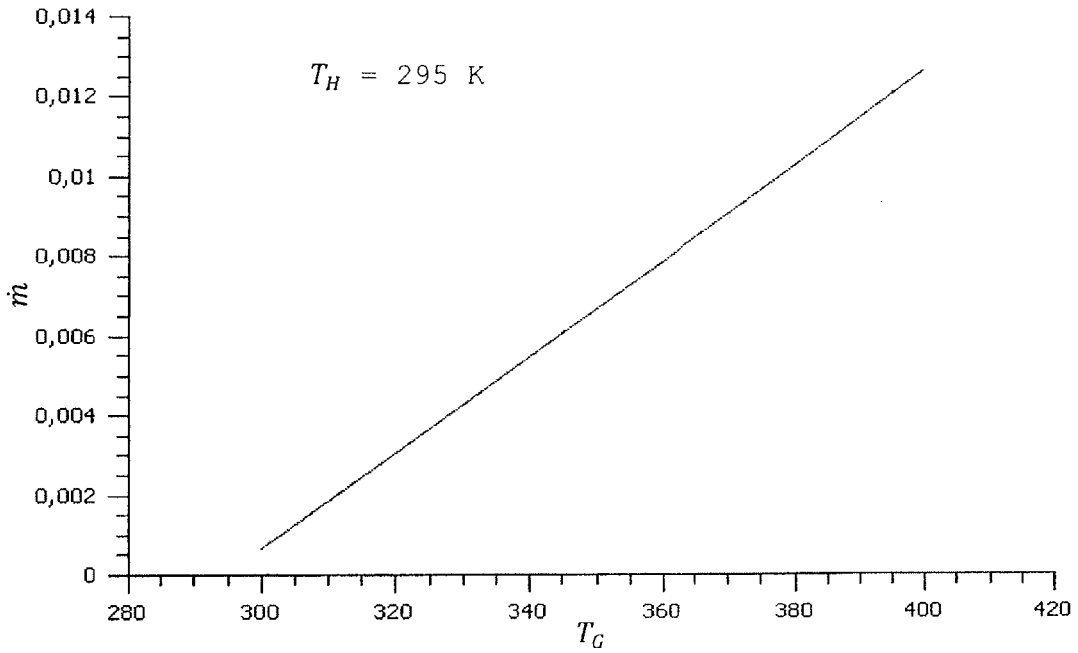
FIG. 4 shows the mass diffusion rate as a function of the gas temperature at a predetermined transport surface temperature.
Figure 5:
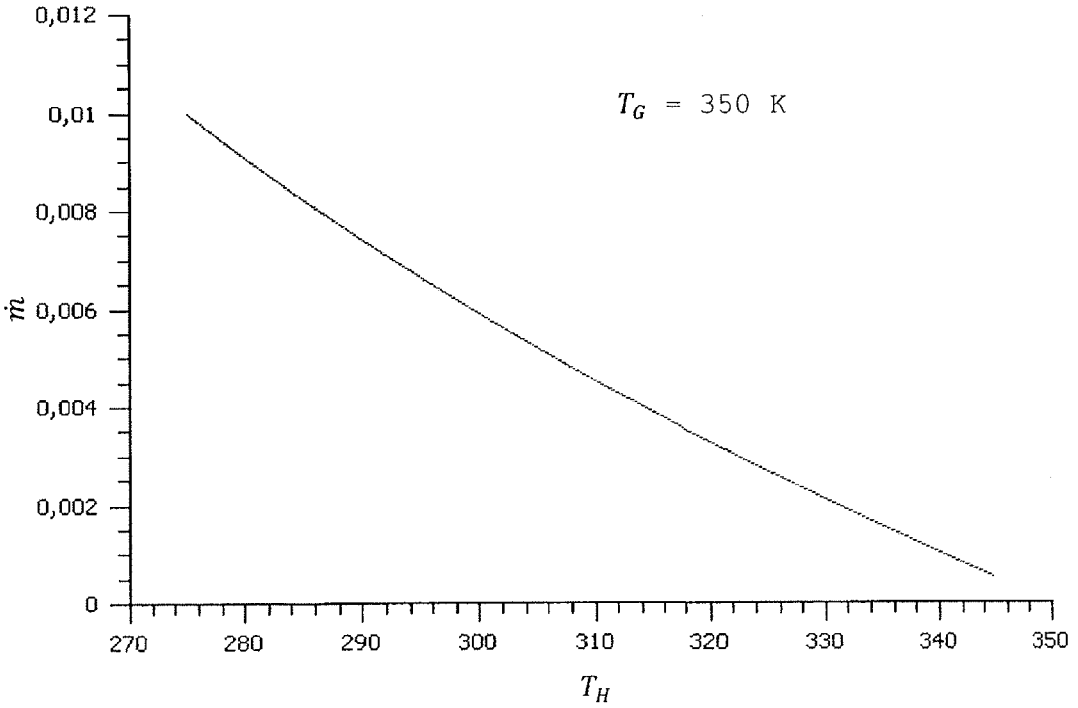
FIG. 5 shows the mass diffusion rate as a function of the transport surface temperature at a predetermined gas temperature.

As is apparent in particular from FIGS. 3 to 5, the mass diffusion rate can be achieved by increasing the first temperature $T_G$. It is also apparent that an increase in the second temperature $T_H$ causes a decrease in the mass diffusion rate.

Figure 6:
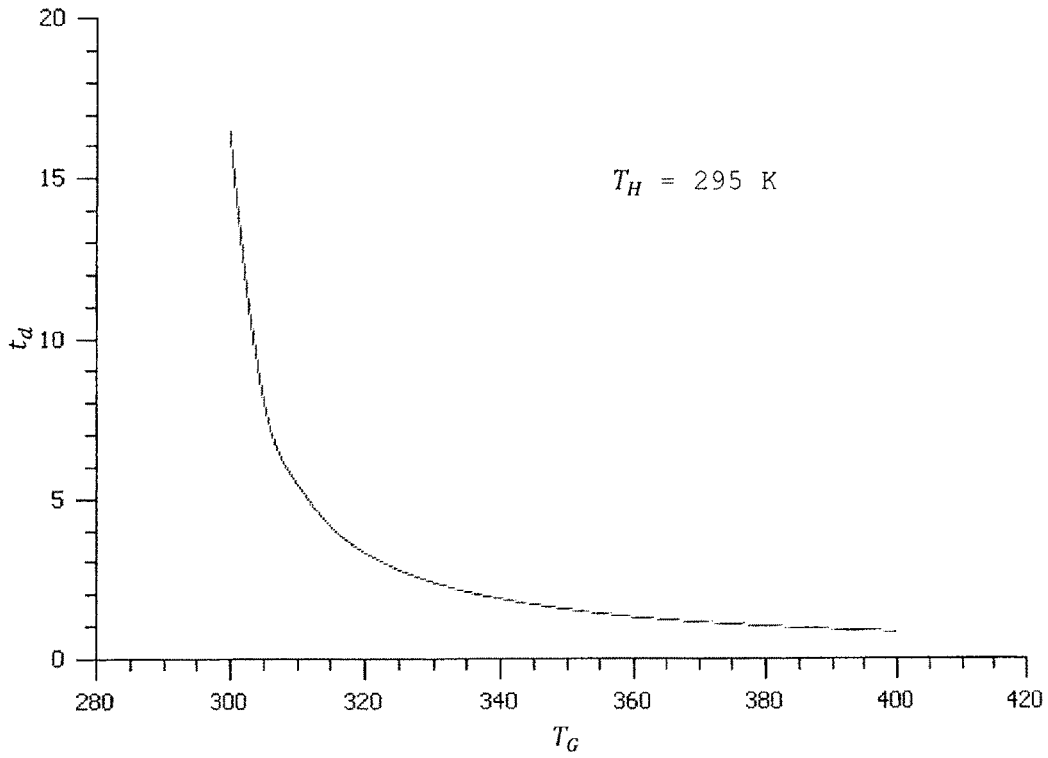
FIG. 6 shows the drying duration as a function of the gas temperature at a predetermined transport surface temperature.
Figure 7:
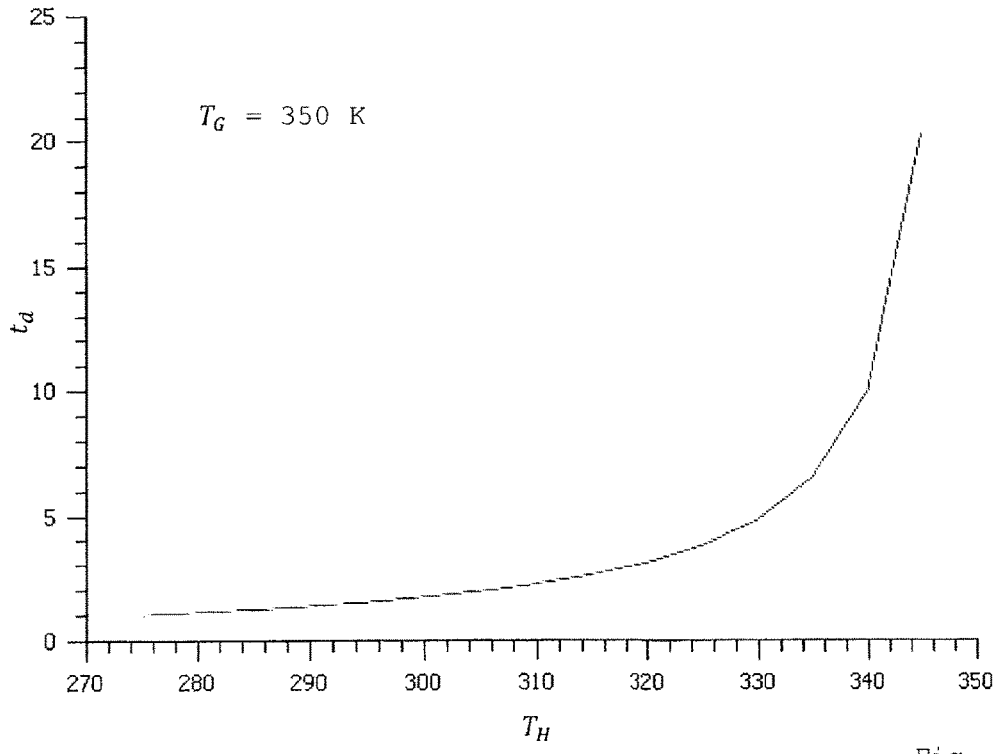
FIG. 7 shows the drying duration as a function of the transport surface temperature at a predetermined gas temperature.

As is apparent in particular from FIGS. 6 and 7, a reduction in the drying time can only be achieved when the second temperature $T_H$ is selected to be low and the first temperature $T_G$ is selected to be high. Both temperatures $T_G$ and $T_H$ can be set so that $T_I$ can be controlled. For example, $T_I$ can be kept at room temperature.

Figure 8:
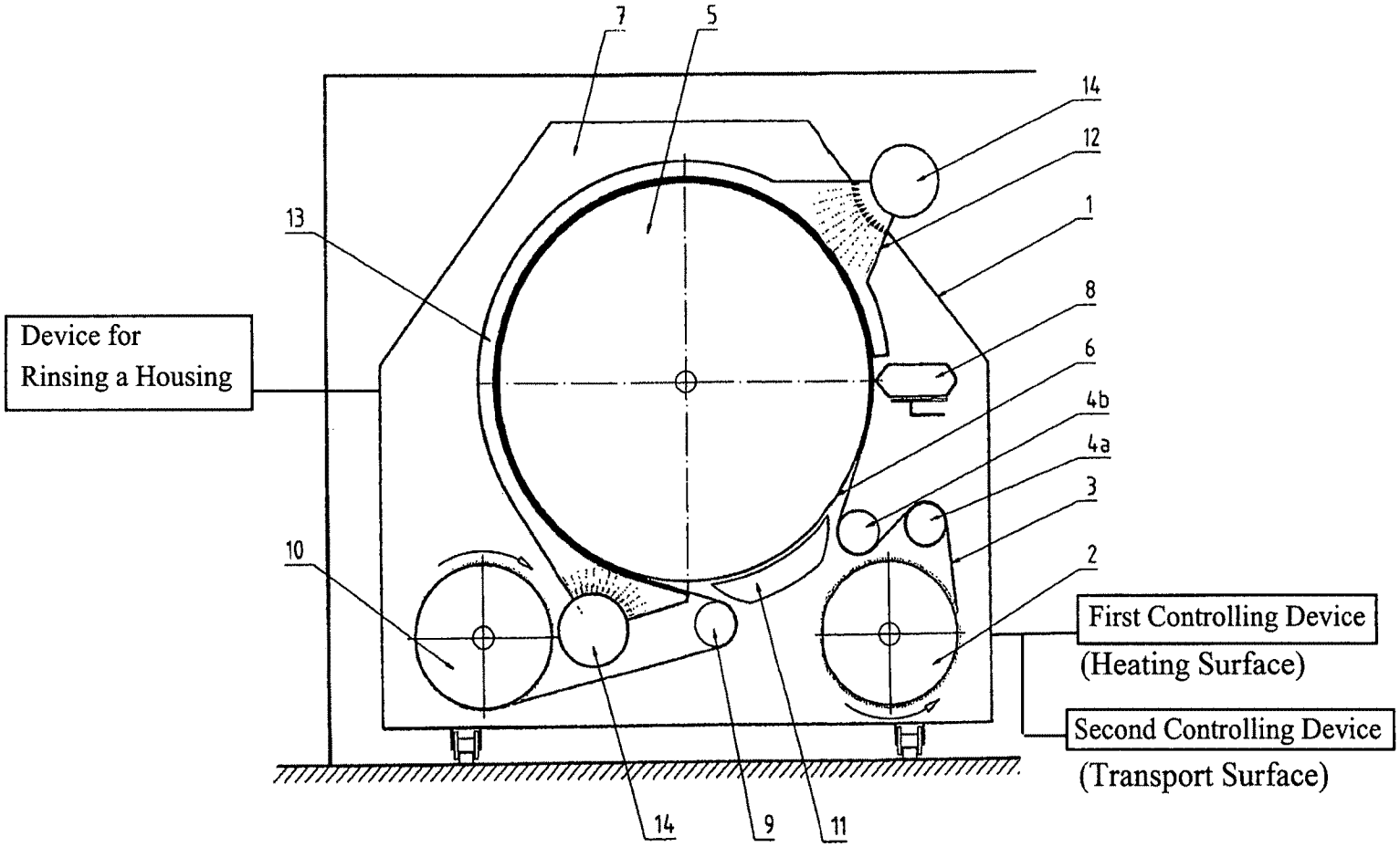
FIG. 8 shows a schematic sectional view through one exemplary embodiment of a diffusion dryer according to the invention.

FIG. 8 shows a schematic sectional view of one exemplary embodiment of a diffusion dryer according to the invention. A supply roller 2, on which the substrate 3 to be coated is accommodated, is located in a housing 1. The substrate 3 is guided over first tension pulleys 4*a*, 4*b* onto a transport roller 5. A lateral or transport surface 6 of the transport roller 5 is surrounded by a drying device 7 in some regions, preferably over an angle of 180 to 270°. Upstream of the drying device 7, a slotted nozzle tool denoted by reference numeral 8 is provided for applying a fluid film F onto the substrate 3. At least one further tension pulley 9, over which the substrate 3 is rolled onto a roller 10, is located downstream of the drying device 7. Reference numeral 11 denotes a roller cleaning device, which is disposed downstream of the drying device 7 and upstream of the coating tool 8.

The drying device 7 comprises an additional housing 12. The additional housing 12 is provided with suction devices 14, which are used to suction off a liquid vapor escaping from the fluid film F.

Figure 9:
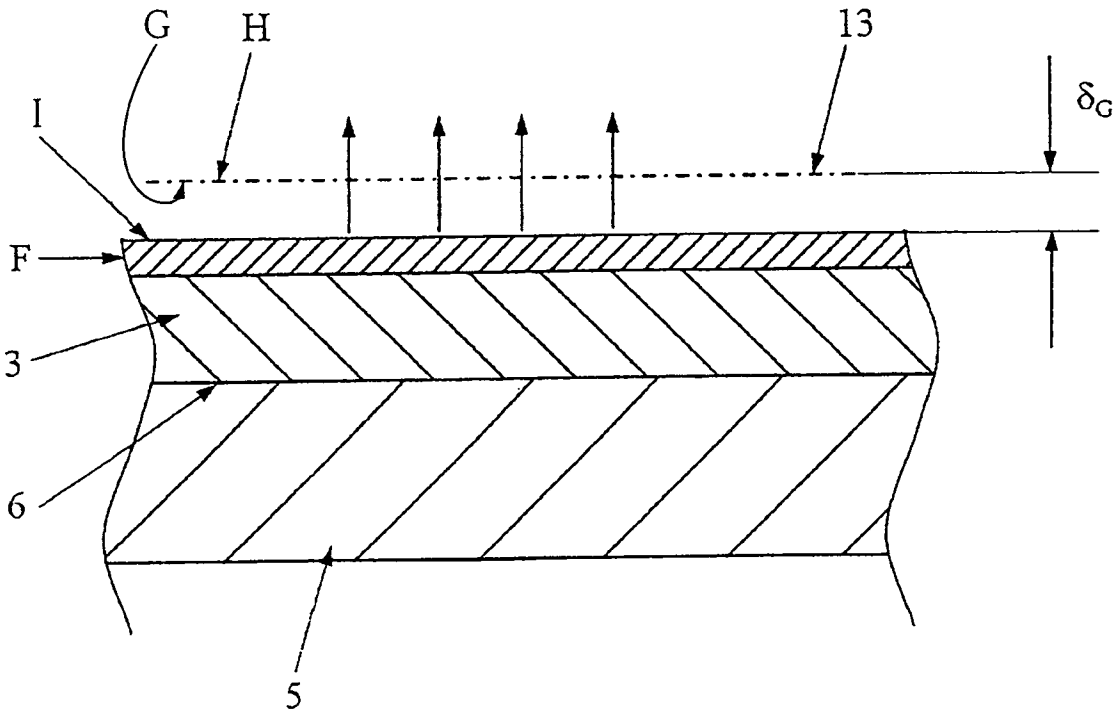
FIG. 9 shows a schematic detailed view according to FIG. 8.

As can be seen in particular in combination with FIG. 9, a heat source 13 accommodated in the additional housing 12 can be formed of resistance wires, for example, which are disposed in a grid-shaped manner. The heating wires form a heating surface G, which is disposed at a distance $\delta_G$ of 0.1 mm to 1.0 mm, for example, opposite the interface I of the fluid film F. The suction devices 14, which are not shown in detail in FIG. 9, result in the formation of a flow, which develops essentially perpendicularly to the transport surface 6 and is identified in FIG. 9 by arrows. Advantageously a negative pressure is generated in the intermediate space between the interface I and the heating surface H by the suction devices 14. This prevents potentially flammable liquid vapors from escaping into the surroundings. The housing 1 can additionally be rinsed with a protective atmosphere so as to prevent a risk of fire or explosion by escaping flammable liquid vapors.

The device according to the invention shown in FIG. 8 has a particularly compact design. Instead of one transport roller 5, it is also possible to use multiple transport rollers 5. A drying section can thus be enlarged, which makes it possible to dry relatively thick fluid films F as well. Moreover, the device according to the invention can be used in combination with conventional convection dryers. For this purpose, the device according to the invention is expediently used upstream of a conventional convection dryer. By using the device according to the invention in combination with a conventional convection dryer, the energy that is used to operate the conventional convection dryer can be drastically reduced.

Figure 10:
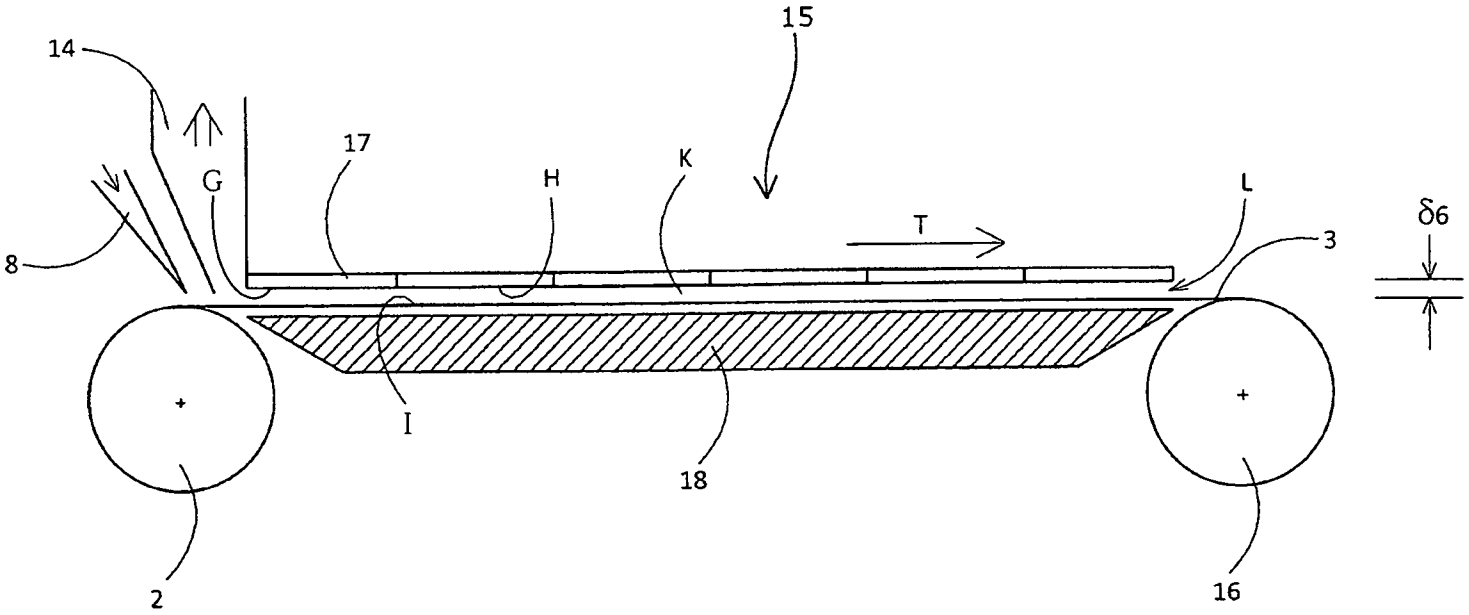
FIG. 10 shows a schematic sectional view through another exemplary embodiment of a diffusion dryer according to the invention.

FIG. 10 shows a schematic sectional view through a further exemplary embodiment of a diffusion dryer according to the invention or of a further drying device 15. The substrate 3 is again accommodated on a supply roller 2 and is transported by a driven roller 16. Reference numeral 8 again denotes a slotted nozzle tool for applying a fluid film onto the substrate 3 and is disposed upstream of an additional drying device 15.

The additional drying device 15 includes heating elements 17 in the transport direction T, which can be plate-shaped resistance heating elements disposed behind one another in the transport direction T. In this embodiment, the heating elements 17 form an essentially closed heating surface H and are disposed at a distance $\delta_G$ of 2 to 10 mm from a substrate surface. The additional drying device 15 thus includes a rectangular channel K having the height $\delta_G$, through which the substrate 3 is guided in the transport direction T.

At the upstream end of the additional drying device 15, air L is suctioned into the channel K by way of the suction device 14 and moved counter to the transport direction T in the direction of the suction device 14 in a counter flow. A flow velocity is 30 cm/s to 3 m/s, for example.

An additional transport surface 18 of the additional drying device 15 is also designed to be planar here. It can likewise be designed to be heatable (not shown here).

LIST OF REFERENCE NUMERALS

1 housing
2 supply roller
3 substrate
4*a*, 4*b* tension pulley
5 transport roller
6 transport surface
7 drying device
8 slotted nozzle tool
9 additional tension pulley
10 roller
11 roller cleaning device
12 additional housing
13 heat source
14 suction device
15 additional drying device
16 driven roller
17 heating element
18 additional transport surface
$\delta_G$ distance
F fluid film
G heating surface
I interface
L air
T transport device

The invention claimed is:

1. A method for drying a fluid film, which is applied to a surface of a substrate and includes a vaporizable liquid, comprising following steps:

transporting the substrate on a transport surface of a transport device along a transport direction through a drying device;

vaporizing the liquid by way of a heat source having a heating surface, wherein the heating surface is disposed at a distance of 0.1 mm to 15.0 mm opposite the surface of the substrate, wherein a heat is essentially transmitted from the heating surface to the fluid film by way of direct heat conduction;

removing a vaporized liquid in a direction of the heat source; and heating the transport surface by way of an additional heat source, wherein in the step of vaporizing the liquid by way of the heat source, the heating surface has a first temperature $T_G$, and the first temperature $T_G$ of the heating surface is controlled as a function of an interface temperature $T_I$ of the fluid film, wherein the interface temperature $T_I$ of the fluid film is detected by an infrared measuring device, and wherein in the step of heating the transport surface, the transport surface has a second temperature $T_H$, and the second temperature $T_H$ of the transport surface generated by the additional heat source is controlled as the function of the interface temperature $T_I$ of the fluid film.

2. A method according to claim 1, wherein the first temperature $T_G$ of the heating surface is controlled in a range of 80° C. to 200° C.

3. A method according to claim 1, wherein the second temperature $T_H$ of the transport surface is controlled so that a following relationship is met:

$$T_H = T_I + \Delta T,$$

where $T_I$ ranges from 5° C. to 40° C. and $\Delta T$ ranges from 5 to 10° C.

4. A method according to claim 1, wherein in the step of vaporizing the liquid, the liquid is carried out in a nitrogen or carbon dioxide atmosphere.

5. A method according to claim 1, wherein in the step of vaporizing the liquid, the heating surface facing the substrate is disposed at a distance of 0.2 mm to 5.0 mm opposite the surface of the substrate.

6. A method according to claim 1, wherein the second temperature $T_H$ of the transport surface is controlled so as to always be lower than the first temperature $T_G$ of the heating surface.

7. A method according to claim 1, wherein a temperature difference between the first temperature $T_G$ of the heating surface and the second temperature $T_H$ of the transport surface is controlled so that the temperature difference between the first temperature $T_G$ of the heating surface and the second temperature $T_H$ of the transport surface changes along the transport direction.

8. A method according to claim 1, wherein one heat source through which a flow is possible is used as the heat source, and in the step of removing the vaporized liquid, the vaporized liquid is removed through the one heat source.

9. A method according to claim 1, wherein in the step of vaporizing the liquid, an electrical heating source is used as the heat source.

10. A method according to claim 1, wherein in the step of vaporizing the liquid, a heat exchanger is used as the heat source.

11. A method according to claim 1, wherein in the step of transporting the substrate, the transport device including at least one rotatable roller, a lateral face of which forms the transport surface, is used.

12. A device for drying a fluid film, which is applied to a surface of a substrate and includes a vaporizable liquid, comprising:

a transport device for transporting the substrate on a transport surface along a transport direction;

a heat source that is provided opposite to the substrate and has a heating surface, which is disposed at a distance of 0.1 to 15.0 mm opposite the surface of the substrate so that a heat is essentially transmitted from the heating surface to the fluid film by way of direct heat conduction; and a device for removing a vaporized liquid in a direction of the heat source, wherein a first controlling device is provided for controlling a first temperature $T_G$ generated by the heating surface as a function of an interface temperature $T_I$ of the fluid film, wherein the interface temperature $T_I$ of the fluid film is detected by an infrared measuring device, and wherein a second controlling device is provided for controlling a second temperature $T_H$ of the transport surface as the function of the interface temperature $T_I$ of the fluid film.

13. The device according to claim 12, wherein an additional heat source is provided for heating the transport surface.

14. A device according to claim 12, wherein a temperature difference between the first temperature $T_G$ of the heating surface and the second temperature $T_H$ of the transport surface is controlled by way of the first controlling device and/or the second controlling device so that the temperature difference between the first temperature $T_G$ of the heating surface and the second temperature $T_H$ of the transport surface changes along the transport direction.

15. A device according claim 12, wherein a device for rinsing a housing surrounding the transport device with a nitrogen or carbon dioxide atmosphere, is provided.

16. A device according to claim 12, wherein the heating surface facing the substrate is disposed at a distance of 0.2 mm to 5.0 mm opposite the substrate surface.

17. A device according to claim 12, wherein one heat source through which a flow is possible is used as the heat source so that the vaporized liquid can be removed through the one heat source.

18. A device according to claim 12, wherein the heat source is an electrical heating source.

19. A device according to claim 12, wherein the heat source is a heat exchanger.

20. A device according to claim 12, wherein the transport device comprises a rotatable roller, a lateral face of which forms the transport surface.

* * * * *